United States Patent [19]

Thomson

[11] 3,957,209

[45] May 18, 1976

[54] METHOD AND APPARATUS FOR SPRAYING INSULATING COATING

[75] Inventor: Gary F. Thomson, Corona del Mar, Calif.

[73] Assignee: Therma-Coustics Manufacturing, Inc., Colton, Calif.

[22] Filed: Jan. 30, 1975

[21] Appl. No.: 545,413

[52] U.S. Cl. ..... 239/429; 239/432; 239/433

[51] Int. Cl.[2] ..... B05B 7/08; B05D 5/00

[58] Field of Search ..... 239/1, 10, 11, 146, 239/310, 314, 325, 428, 429, 432, 433, 543, 544; 118/308

[56] References Cited

UNITED STATES PATENTS

| | | | |
|---|---|---|---|
| 2,366,969 | 1/1945 | Kiggins | 239/544 X |
| 2,392,408 | 1/1946 | Radonich | 239/1 |
| 2,671,692 | 3/1954 | Matirko | 239/432 |
| 2,747,934 | 5/1956 | Fisher | 239/428 X |
| 2,879,948 | 3/1959 | Seibel | 239/428 X |
| 3,174,693 | 3/1965 | Weber, Jr. | 239/325 X |
| 3,606,154 | 9/1971 | Tufts | 239/428 X |
| 3,612,405 | 10/1971 | Heinrich | 239/429 X |
| 3,676,170 | 7/1972 | Kempthorne | 239/428 X |
| 3,844,485 | 10/1974 | Waggoner | 239/543 X |

*Primary Examiner*—Evon C. Blunk
*Assistant Examiner*—Andres Kashnikow
*Attorney, Agent, or Firm*—Harris, Kern, Wallen & Tinsley

[57] ABSTRACT

A method and apparatus for spraying on a desired surface, such as a wall, ceiling, or the like, an insulating coating comprising a mixture of a flowable dry fibrous material and a liquid adhesive, very thoroughly wetting the dry material, the latter comprising cellulose fibers (as opposed to mineral fibers) together with various additives. The wet mixture is sprayed on the desired surface at such a velocity that a substantially uniform insulating coating is produced requiring no subsequent tamping, the coating being uniform as to density, consistency, appearance, and the like. The cellulosic fibers are derived from ground paper, such as bleached sulfate paper, or unbleached newspaper, kraft paper, or the like, mixed with various additives to provide the finished insulating layer with fire and rot resisting qualities, to color same, and the like.

3 Claims, 4 Drawing Figures

METHOD AND APPARATUS FOR SPRAYING INSULATING COATING

More particularly, the spraying method and appararatus of the invention utilize a discharge nozzle provided with wall means defining a passage means for the dry material, and at least two circumferentially spaced, liquid spray nozzles carried by the wall means within the passage means and having means for directing fan-shaped sprays of the liquid laterally of the passage means and downstream of the passage means toward a convergent outlet end thereof, the liquid sprays from the spray nozzles being in planes so directed so as to tend to intersect within the passage means downstream from the spray nozzles, whereby to thoroughly wet the dry material flowing through the passage means. The spray nozzles are located upstream from the convergent outlet end of the passage means a distance such that the dry material is thoroughly wetted without tending to agglomerate. The mixture discharged from the convergent outlet end of the spray nozzle is so thoroughly wetted with the foregoing nozzle structure that a very uniform coating results, with virtually no overspray and resultant waste. Also, with the thorough wetting the invention achieves, a high density layer is readily attainable.

BACKGROUND OF INVENTION

The present invention relates in general to a spraying apparatus and method for mixing a flowable dry material with a liquid and for discharging the mixture against a surface to be coated. The invention finds particular utility in mixing cellulose fibers, which may contain various additives, with a liquid, which may include an adhesive, and spraying the resulting mixture against a desired surface, such as a building wall or ceiling, or the like, to produce an insulating coating. As a matter of convenience, such an application of the invention will be considered herein without necessarily limiting it specifically thereto.

The prior art is replete with examples of apparatuses for mixing dry materials and liquids and spraying the resulting mixtures against surfaces to be coated. The dry materials may range from portland cement, or mixtures thereof, to fibrous materials comprising mineral or cellulosic fibers. Similarly, the liquids may range from water to liquid adhesives.

Apparatuses which premix the dry and liquid materials and then pump the mixture to a spray nozzle simply will not work with fibrous materials, and particularly with cellulosic materials, because the pumping action breaks the mixture delivered to the discharge nozzle down into slugs of fibrous material and liquid, an obviously undesirable condition.

Another prior approach is to discharge the fibrous material in a dry state from a nozzle and then spray the liquid into the emerging stream of dry material externally of the nozzle, i.e., downstream from the downstream end thereof. This procedure works relatively well for a dry material comprising mineral fibers, but does not operate entirely satisfactorily with cellulosic fibers since the wetting of such fibers is not sufficiently uniform to preclude impingement of dry balls of the cellulose-base material on the surface being coated, a condition which again is obviously undesirable since it leads to nonuniformity of such things as thickness, density, consistency, appearance, and the like. Also, there may be considerable overspraying and resultant waste.

Other prior art attempts to wet the dry material while flowing through the discharge nozzle, or a passage leading thereto, utilize such expedients as venturis, liquid ejectors centrally located in the confined stream of dry material, and the like. Such expedients have not proven satisfactory, particularly with dry materials containing cellulose fibers, for various reasons, the principal one being nonuniform wetting. Central liquid ejectors and venturis suffer the additional disadvantage of providing obstructions to the flow of the dry material. Nevertheless, internal wetting, i.e., injection of the liquid into a confined stream of the dry material, has the potential for more uniform, and, equally important, more extensive, wetting of the dry material than external wetting, i.e., wetting of the dry material after it emanates from the discharge nozzle.

OBJECTS AND SUMMARY OF INVENTION

With the foregoing background in mind, the primary object of the present invention is to provide an improved method and apparatus for wetting a dry fibrous material with a liquid internally of a confined stream of the dry material, in such a way as to achieve substantially uniform and extremely extensive wetting without obstructing the flow of the dry material, as by venturis, central liquid ejectors, or the like.

More particularly, an important object of the invention is to provide a method and apparatus wherein the liquid is sprayed into a confined stream of dry material flowing through an unobstructed passage means from one or more spraying locations, and preferably at least two circumferentially spaced spraying locations, at the sides of the confined stream.

Still more particularly, an important object of the invention is to direct the liquid spray or sprays laterally of the passage means, and downstream of the passage means toward the outlet end thereof, the liquid sprays being so directed as to tend to intersect within the passage means so as to thoroughly and substantially uniformly wet the dry material flowing through the passage means.

A further significant object is to provide spray nozzles which direct fan-shaped sprays of liquid laterally of the passage means and downstream of the passage means toward the convergent outlet end thereof, the fan-shaped sprays from the spray nozzles being disposed substantially in planes so directed as to tend to intersect within the passage means downstream of the nozzles, and the liquid being directed to the spray nozzles at a sufficiently high pressure that the liquid is at least partially atomized as it emerges from the spray nozzles.

With the foregoing construction, extremely thorough and substantially uniform wetting of the dry material flowing through the passage means is assured. Thorough wetting is an important feature because the greater quantity of liquid added to the dry material with the internal wetting of the present invention insures a higher density and more uniform insulating layer than can be obtained with external wetting.

Each spray nozzle, which may be conventional, is provided with a laterally elongated, divergent discharge passage capable of producing a fan-shaped spray having an included angle within the range of, for example, 25° to 40° and an area at its discharge end of, for example, from 0.010 to 0.050 sq. in., the latter having a capacity of at least five times that of the former for a given pressure. A 0.010 to 0.020 sq. in. nozzle will produce a relatively dry insulating layer of relatively low density, while a 0.050 sq. in. nozzle will, for the same liquid pressure, produce a very much wetter and much more dense insulating layer, the degree of wetting being more important in obtaining a high density than the discharge velocity of the wetted fibrous material. The amount of liquid introduced into the fibrous material may also be varied by varying the pressure of the liquid delivered to the spray nozzles.

The invention may be summarized as including, and another important object is to provide a spraying apparatus, for mixing a flowable dry fibrous material with a liquid, which includes: a discharge nozzle provided with wall means defining a passage means for the dry material having inlet and outlet ends; and at least two circumferentially spaced, liquid spray nozzles carried by the wall means within the passage means at locations on different sides thereof and having means for directing sprays of the liquid laterally of the passage means and downstream of the passage means toward the outlet end thereof, the liquid sprays from the spray nozzles being so directed as to tend to intersect within the passage means, whereby to thoroughly and substantially uniformly wet the dry material flowing through the passage means.

The invention may be further summarized as including, and still another important object is to provide a method of mixing a flowable dry fibrous material with a liquid, which includes: flowing the dry material in a confined stream having a convergent outlet end; and spraying the liquid laterally into the confined stream and downstream thereof from circumferentially spaced locations on different sides of the confined stream.

Yet another object of the invention is to provide a construction wherein the wall means defining the passage means is provided with internal recesses which communicate with the passage means and in which the spray nozzles are disposed, whereby to minimize obstruction by the spray nozzles to flow of the dry material through the passage means.

A further object is to locate the spray nozzles upstream from the convergent outlet end of the passage means a distance sufficient to insure thorough wetting of the dry material, but insufficient to permit any appreciable agglomeration of the wetted material into fibrous clumps, or the like, prior to ejection at the convergent outlet end of the discharge nozzle. This result may be achieved by locating the spray nozzles upstream from the convergent outlet end of the passage means a distance of approximately two to three times the internal diameter of the passage means upstream from such outlet end.

Another object is to discharge the mixture of the dry material and liquid from the convergent outlet end of the passage means at a velocity consistent with the density to be achieved, which density is also dependent on the mixture wetness, as previously discussed. The velocity may be as high as of the order of 10,000 to 15,000 feet per minute to insure a uniform, high density, layer on the surface being sprayed, despite the occasional presence of a wad of wetted material, or one of incompletely wetted material. In other words, any agglomerations of wetted or incompletely wetted material impact the surface being sprayed with such force as to be flattened against the surface and to be substantially completely integrated into the remainder of the layer so that their presence is undeterminable.

Another advantage achievable with the method and apparatus of the present invention is that the layer applied to the desired surface adheres thereto so thoroughly, and is cohesive, that it is difficult to remove any particles by rubbing contact, or the like.

EXAMPLES OF DRY MATERIALS AND LIQUID COMPOSITIONS

As previously indicated, the present invention is particularly applicable to mixing with a liquid a flowable dry fibrous material which is basically cellulose, with various additives to achieve certain desirable characteristics. The cellulosic fibers may be derived from ground paper, such as bleached sulfate paper, or unbleached newsprint, kraft paper, or the like.

A typical dry fibrous material may have the following composition, the weights given being in pounds:

| Weight | Ingredient |
|---|---|
| 4,918 | ground paper |
| 700 | 10 mol borax powder |
| 700 | boric acid powder |
| 2 | dry pigment (dye) |
| 160 | dry adhesive |
| 6,480 | |

It should be pointed out that the dry pigment called for in the foregoing example is optional, being used only if a colored layer is desired. If the natural color resulting from the spraying process is desired, the dry pigment is omitted.

The liquid mixed with the dry material in the spraying apparatus of the invention may be a water base latex adhesive concentrate, containing, for example, 45 to 65 percent solids, mixed with water in the ratio of 8 to 12 parts of water to 1 part of concentrate, depending on the percentage of solids present, to provide the desired liquid adhesive. Approximately 2,400 gallons of this liquid adhesives are required for the total weight of dry material in the example given, depending on the coating density desired. The effectiveness of the present invention in mixing the liquid adhesive with the dry material permits the use of a much higher proportion of liquid than prior systems, which is a very important advantage.

Various other modifications may be made in the examples given. For instance, the water base latex adhesive may be omitted completely by increasing the amount of dry adhesive in the dry fibrous material, with the result that the liquid sprayed into the confined stream of dry material may be water only.

Various other changes may be made in the ingredients and proportions of the dry material and the liquid, depending on such things as the ingredients used and the characteristics desired for the finished insulating layer.

It should be pointed out that the purpose of the borax in the dry mix is to provide the insulating layer with such qualities as fire resistance, rot and fungus resistance, and the like.

DESCRIPTION OF DRAWING

Illustrated in the accompanying drawing is an exemplary spraying apparatus of the invention which is capable of carrying out the method thereof, utilizing the foregoing, or other, dry and liquid materials. In the drawing:

FIG. 1 is a semidiagrammatic view showing a spraying system of the invention in use to apply a high density insulating coating to a wall, or the like;

DETAILED DESCRIPTION OF EXEMPLARY EMBODIMENT OF SPRAYING APPARATUS OF INVENTION

Figure 1:
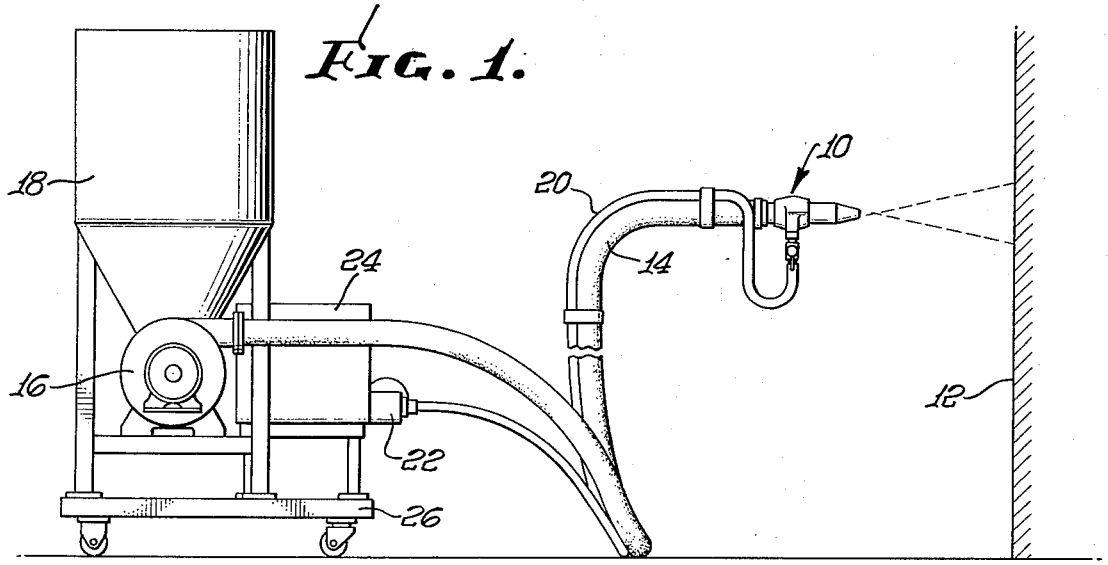
Figure 2:
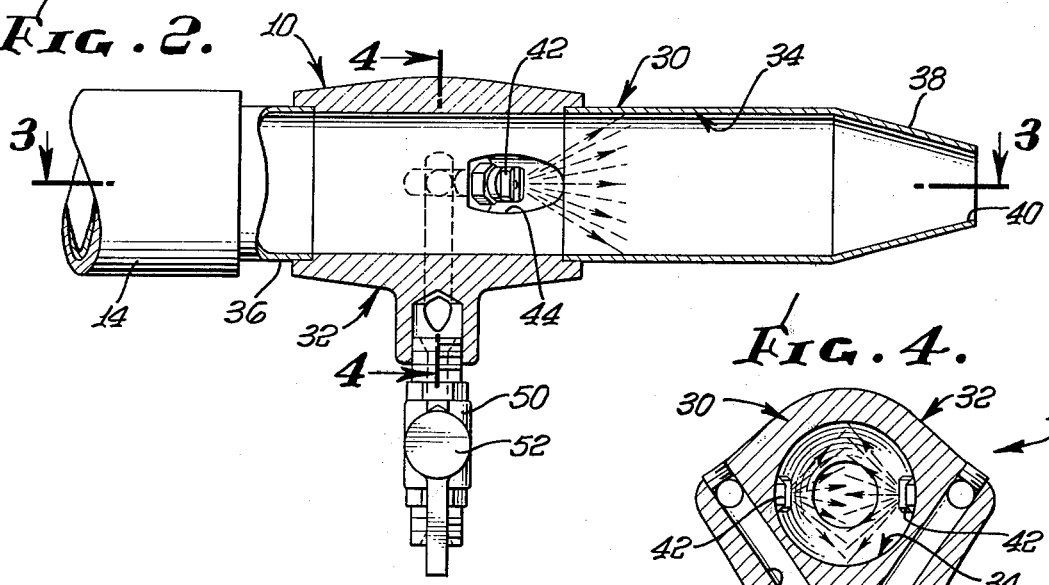
FIG. 2 is a longitudinal sectional view through a spraying apparatus for mixing a flowable dry fibrous material and a liquid.
Figure 4:
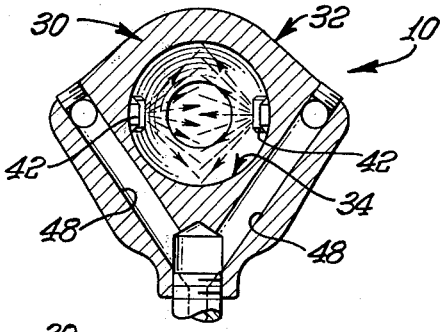
FIGS. 3 and 4 are sectional views respectively taken as indicated by the arrowed lines 3—3 and 4—4 of FIG. 2 of the drawing.

In the drawing, the numeral 10 designates generally the spraying apparatus of the invention, which is shown in use to spray a high density insulating layer on a wall 12. As hereinbefore explained, the spraying apparatus 10 mixes a flowable dry fibrous material with a liquid just prior to discharging the resulting mixture against the wall 12.

The flowable dry fibrous material is supplied to the spraying apparatus 10 through a hose 14 leading to a blower 16 which takes the dry fibrous material from a supply hopper 18. The liquid is supplied to the spraying apparatus 10 through a hose 20 supplied by a pump 22 from a tank 24. If desired, the blower 16, hopper 18, pump 22 and tank 24 may be mounted on a wheeled base 26.

The blower 16 has sufficient capacity to discharge the mixture emanating from the spraying apparatus 10 at a velocity which may be as high as 10,000 to 15,000 feet per minute. The pump 22 has sufficient capacity to produce the liquid flow rate necessary to achieve the proportions of dry material and liquid hereinbefore set forth, and supplies the liquid to the spraying apparatus 10 at a pressure sufficient to atomize the liquid within the spraying apparatus to insure thorough and substantially uniform wetting. For example, the pump 22 may have a discharge pressure of the order of 200 psi, but this may vary with spray nozzle area.

Turning now to a detailed consideration of the spraying apparatus 10, it comprises a discharge nozzle 30 provided with wall means 32 defining a passage means 34 for the dry material. The passage means 34 is provided with an inlet end 36 connected to the hose 14, and is provided with a convergent outlet end 38. The passage means 34 is preferably of constant diameter between its inlet end and the convergent outlet end 38. For optimum results, the area of the passage means 34 upstream from the convergent outlet end 38 is approximately five times the area of the discharge opening 40 at the extremity of the convergent outlet end 38.

The discharge nozzle 30 is shown as comprising two liquid spray nozzles 42 circumferentially spaced apart by 180° and carried by the wall means 32 within the passage means 34 on opposite sides of the confined stream of dry material flowing through the passage means. To minimize flow obstructions, the spray nozzles 42 are set in diametrically opposite recesses 44 in the wall means 32 and project into the passage means 34 only slightly. The spray nozzles 42 may be secured by threading them into bores 46 in the wall means 42, which bores communicate with manifold passages 48 leading to a fitting 50 connected to the discharge nozzle 30. The inlet end of the fitting 50, which preferably includes a shutoff valve 52, is connected to the liquid hose 20.

Figure 3:
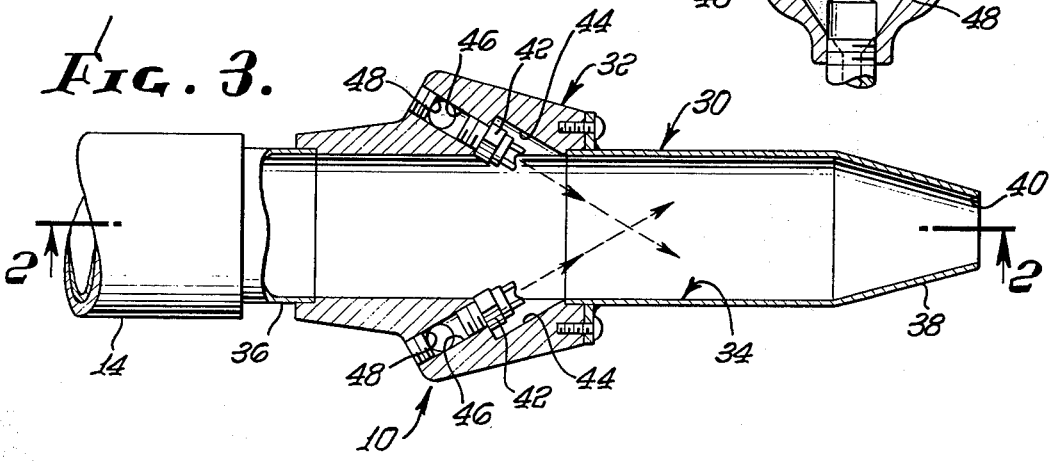

The spray nozzles 42, which, per se, may be conventional, are so oriented as to direct fan-shaped sprays of liquid, having included angles ranging, for example, from 25° to 40°, laterally of and into the passage means 34 and downstream of the passage means toward the convergent outlet end 38 thereof. These fan-shaped sprays are disposed substantially in planes so directed as to tend to intersect within the passage means downstream from the spray nozzles, as shown in FIG. 3 of the drawing. The fan-shaped sprays, which consist primarily of atomized liquid, may actually extend across the passage means 34 and bounce off the wall means 32 on the opposite sides of the passages means from the sides on which the corresponding spray nozzles 42 are located, thereby insuring thorough and substantially uniform wetting of the dry material flowing through the passage means.

The spray nozzles 42 are located far enough upstream from the convergent outlet end 32 to achieve thorough and substantially uniform wetting of the dry material, without being located so far upstream as to permit the wetted material to conglomerate into wads or balls to any significant extent. For this purpose, the spray nozzles 42 are located upstream from the convergent outlet end 38 of the passage means 34 a distance of approximately two or three times the internal diameter of the passage means upstream from such outlet end.

It is thought that the operation of the spraying apparatus 10 of the invention, and the manner in which it performs the method of the invention, will be clear from the foregoing description so that no further explanation is required.

Although exemplary embodiments of the invention have been disclosed for illustrative purposes, it will be understood that various changes, modifications and substitutions may be incorporated in such embodiments without departing from the invention as hereinafter claimed.

I claim as my invention:

1. In a spraying apparatus for mixing a flowable dry fibrous material with a liquid, the combination of:

a. a discharge nozzle provided with wall means defining a substantially uniform diameter passage means for the dry material having an inlet end, and having an outlet end portion convergent in the downstream direction; and b. at least two circumferentially spaced, liquid spray nozzles carried by said wall means within said passage means at locations on different sides thereof and having means for directing fan-shaped sprays of the liquid laterally of said passage means and toward the downstream end of said passage means towards said outlet end thereof, the liquid sprays from said spay nozzles being so directed as to fan laterally of said passage means and to tend to intersect within said passage means entirely within a region upstream from said outlet end portion thereof, whereby to thoroughly and substantially uniformly wet the dry material flowing through said passage means.

2. A spraying apparatus as defined in claim 1 wherein said spray nozzles are located upstream from said convergent outlet end of said passage means a distance of approximately two to three times the internal diameter of said passage means upstream from said convergent outlet end.

3. A spraying apparatus as set forth in claim 1 wherein said wall means is provided with internal recesses which communicate with said passage means and in which said spray nozzles are disposed.

* * * * *